US006422913B1

(12) United States Patent
Trejo

(10) Patent No.: US 6,422,913 B1
(45) Date of Patent: Jul. 23, 2002

(54) DECORATIVE WIND DRIVEN SCULPTURE

(76) Inventor: Phillip Trejo, 341 Spring Lake Blvd., NW., Port Charlotte, FL (US) 33952

( * ) Notice: Subject to any disclaimer, the term of this patent is extended or adjusted under 35 U.S.C. 154(b) by 0 days.

(21) Appl. No.: 09/339,512

(22) Filed: Jun. 24, 1999

(51) Int. Cl.[7] ..... A63H 33/40
(52) U.S. Cl. ..... 446/217; 40/479; 73/170.05
(58) Field of Search ..... 446/217, 218, 446/176, 213, 199, 201, 236, 241; 40/479; 73/170.05

(56) References Cited

U.S. PATENT DOCUMENTS 272,846 A * 2/1883 Bartholomew ..... 446/199
1,255,008 A * 1/1918 Hawkins ..... 446/199
1,794,677 A * 3/1931 Dunwody ..... 40/479
2,870,557 A * 1/1959 Cook ..... 40/479
2,965,991 A * 12/1960 Simmons ..... 40/479
4,094,091 A * 6/1978 Kupperman et al. ..... 46/53
5,085,075 A * 2/1992 Baker ..... 446/199

* cited by examiner

*Primary Examiner*—Derris H. Banks
*Assistant Examiner*—Urszula M. Cegielnik
(74) *Attorney, Agent, or Firm*—William E. Noonan

(57) ABSTRACT

A decorative wind driven sculpture includes an elongate support member that is mounted to and extends upwardly from the ground. An exterior frame is mounted proximate an upper end of the support and is rotatable about a first axis that is generally aligned with a longitudinal axis of the support member. An interior decorative component is mounted within the frame in a rotatable relative to each the frame and the support member about a second axis that is generally aligned with the first axis and the longitudinal axis of the support member. The exterior frame and the interior decorative component are independently rotated by movement of air about the first and second axes respectively.

6 Claims, 4 Drawing Sheets

DECORATIVE WIND DRIVEN SCULPTURE

FIELD OF THE INVENTION

This invention relates to a decorative or ornamental wind driven sculpture that is particularly suited for use in gardens, porches, patios and other outdoor environments.

BACKGROUND OF THE INVENTION

There are various wind driven sculptures presently available for both decorative and functional use. For example, weather vanes are mounted to buildings and in the ground. Ornamental wind sculptures are also used in gardens, porches, patios and similar environments. To date, however, these known sculptures exhibit only a limited range of movement. Pivoting or rotating sculptures typically move about a single axis of rotation only. Where multiple rotating parts are employed, these components are limited to rotating together in a single direction. No known wind sculptures are available that feature multiple parts that rotate independently of one another about a single axis of rotation. Conventional wind sculptures certainly do not allow two decorative parts to rotate simultaneously in opposite directions about the same axis.

SUMMARY OF THE INVENTION

It is therefore an object of this invention to provide a new, unique and an aesthetically pleasing wind sculpture that employs multiple decorative components that are independently rotatable about respective, aligned axes of rotation.

It is a further object of this. invention to provide a decorative wind driven sculpture that is suited for use in gardens, yards, and in other outdoor locations such as verandas, porches, lanais and patios.

It is a further object of this invention to provide a decorative wind driven sculpture featuring a new and improved pivoting mechanism that permits an outer frame and an interior decorative component to pivot independently and in opposite directions about a single longitudinal axis of rotation.

It is a further object of this invention to provide a decorative wind driven sculpture that features virtually frictionless and very attractive movement.

This invention features a decorative wind driven sculpture including an elongate support member that is mounted to and extends upwardly from the ground. An exterior frame is mounted proximate an upper end of the support member and is rotatable about a first axis, which first axis is generally aligned with a longitudinal axis of the support member. An interior decorative component is mounted within the frame and is rotatable relative to each of the frame and the support member about a second axis of rotation that is generally aligned with the first axis and the longitudinal axis of the support member. The exterior frame and the interior decorative component are independently rotated by movement of air about the first and second axes respectively.

In a preferred embodiment, the support member includes an elongate tube or other cylindrical element. The device may further include a sleeve or other cylindrical component attached to the frame. The sleeve is axially aligned and rotatably interengaged with the tube. The sleeve may receive the tube and bearing means may be provided for rotatably interengaging the sleeve and the tube. The device may further include a plug or closure fixed to and closing an upper end of the sleeve. A first bearing may interengage an upper end of the tube and the plug to permit rotation of the plug and the sleeve relative to the tube. The first bearing may include a ball bearing element.

The device may further include a spinner assembly mounted to the sleeve. The spinner assembly may include a second bearing mounted to the plug or sleeve closure, a third bearing mounted to the frame and a shaft rotatably interconnected between the second and third bearings and carrying the interior decorative component. The interior decorative component rotates with the shaft about the second axis, which is defined by the longitudinal axis of the shaft. The second bearing is mounted in a lower bearing receptacle. That receptacle may carry the plug or closure at its lower end. The third bearing may be mounted in an upper bearing receptacle. The upper bearing receptacle is preferably secured to the frame. The second and third bearings may comprise generally annular bushings.

BRIEF DESCRIPTION OF THE DRAWINGS

Other objects, features and advantages will occur from the following description of a preferred embodiment and the accompanying drawings, in which.

Figure 1:
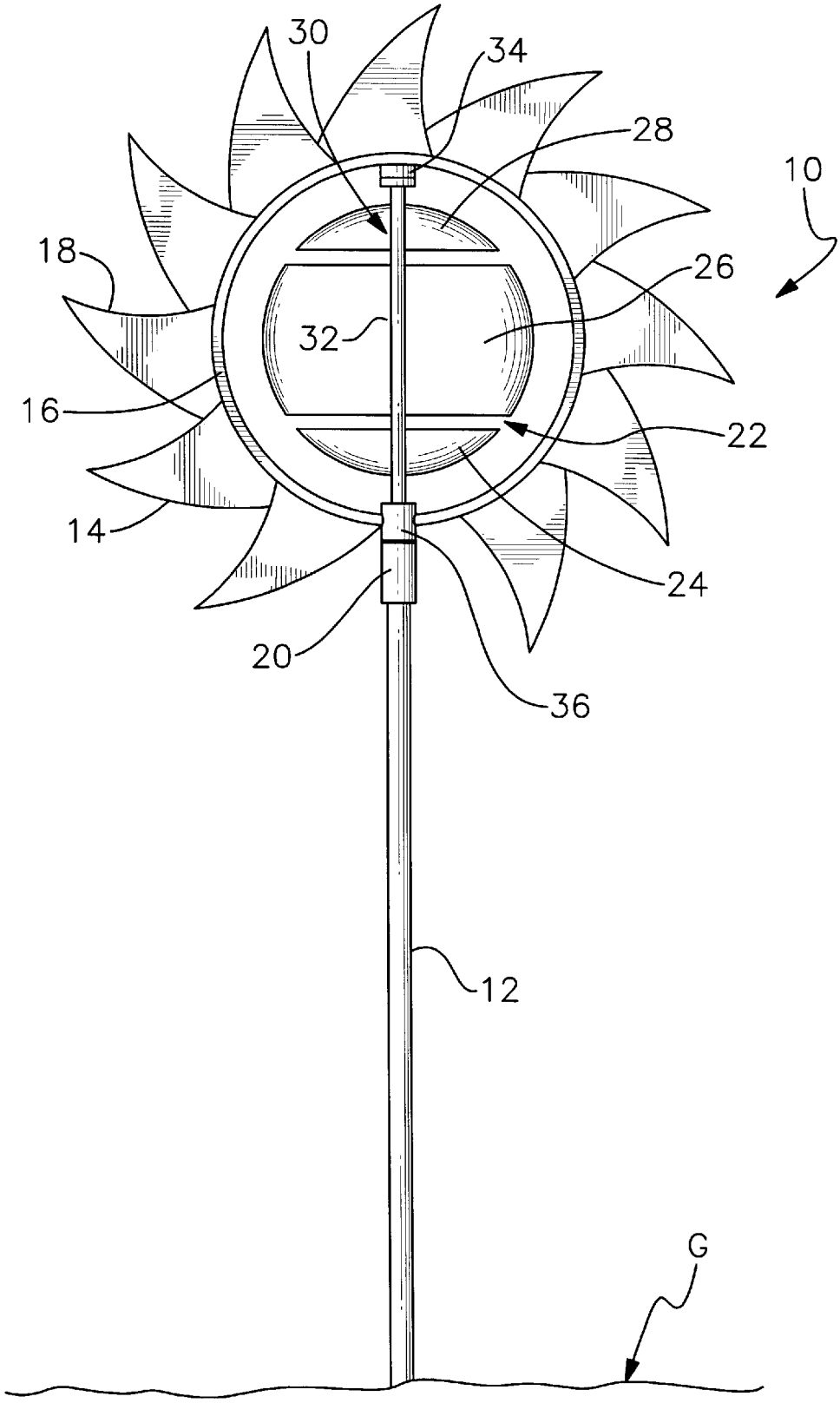
FIG. 1 is a front elevational view of a preferred decorative wind driven sculpture in accordance with this invention.

There is shown in FIG. 1*a* decorative or ornamental wind sculpture 10 that is mounted in the ground G. It should be understood that sculpture 10 may be mounted in a wide variety of outdoor and indoor environments, including gardens, yards, lanais, verandas, porches, patios, etc. In the version disclosed herein, the sculpture is installed in the ground. Alternatively, it may be mounted in a vase, flowerpot or other structure carrying earth, sand or a similar supportive medium.

Sculpture 10 includes an elongate pole or support member 12. The support member has a lower end (not shown) which may be pointed or otherwise sharpened so that it can be readily inserted into ground G. The support member preferably has a generally cylindrical shape although, in alternative embodiments, non-cylindrical shapes may be utilized. Typically, the support pole comprises a piece of copper tubing, which is illustrated more clearly in FIGS. 2 and 3. Support member 12 may alternatively include other durable materials such as metals, metal alloys and plastics. A solid rod may also be employed for the support member. The support member may have various lengths to suit particular decorative applications. In most cases, the lower end of the support member is inserted at least 12 inches into the ground. A starter hole is preferably formed to facilitate insertion.

A decorative exterior frame 14 is mounted rotatably to an upper end of support member 12. In the version disclosed, frame 14 comprises an annular or ring-like element 16 that is composed of copper wire or similar material. A sculptural design component 18 is welded or otherwise secured to annular member 16. Design component 18 includes a floral or sunburst pattern in this embodiment. The design component is typically constructed from copper or materials similar to that of the annular component. Welding is the preferred means of attaching these parts although other forms of attachment may be utilized. It should also be understood that the frame may feature a wide variety of alternative designs. These may comprise sea life, marine, wildlife, floral, abstract and a virtually endless variety of patterns and shapes. Although an annular or ring-like wire component is shown herein, in alternative embodiments that component may be eliminated or replaced by a wire having various other noncircular shapes. (See, for example, FIG. 4)

Decorative component 14 is pivotably or rotatably mounted to the top end of support member 12 by a cylindrical sleeve 20, FIG. 1. This pivoting interconnection is described more fully below. As a result of this construction, frame 14 is able to pivot axially about support member 12 and, more particularly, about an axis that is an extension of the support member's longitudinal axis.

An interior decorative component 22 is rotatably mounted within frame 14. In this version, decorative component 22 comprises fan-like parts or blades 24, 26 and 28, which are pivotably connected to frame 14 by a spinner assembly 30. The decorative parts 24, 26 and 28 again preferably comprise copper or some other durable metal or plastic material. The interior decorative component may again have a virtually limitless number of shapes or configurations.

The spinner assembly 30 includes an elongate shaft 32 to which the decorative parts 24, 26 and 28 are welded or otherwise attached. Shaft 30 is axially rotatably mounted in the frame by a pair of upper and lower bearing cups 34 and 36. Upper bearing cup 34 is welded or otherwise fixed to ring 16 of frame 14. Lower bearing cup 36 is likewise fixed to the upper end of sleeve 20. Ring 16 of frame 14 is welded, soldered or otherwise secured to one or both of sleeve 20 and bearing cup 36. As is described more fully below, the spinner assembly allows the interior decorative component 22 to spin independently of outer frame 14 about an axis that is again generally aligned with the axis of support member 12.

Figure 2:
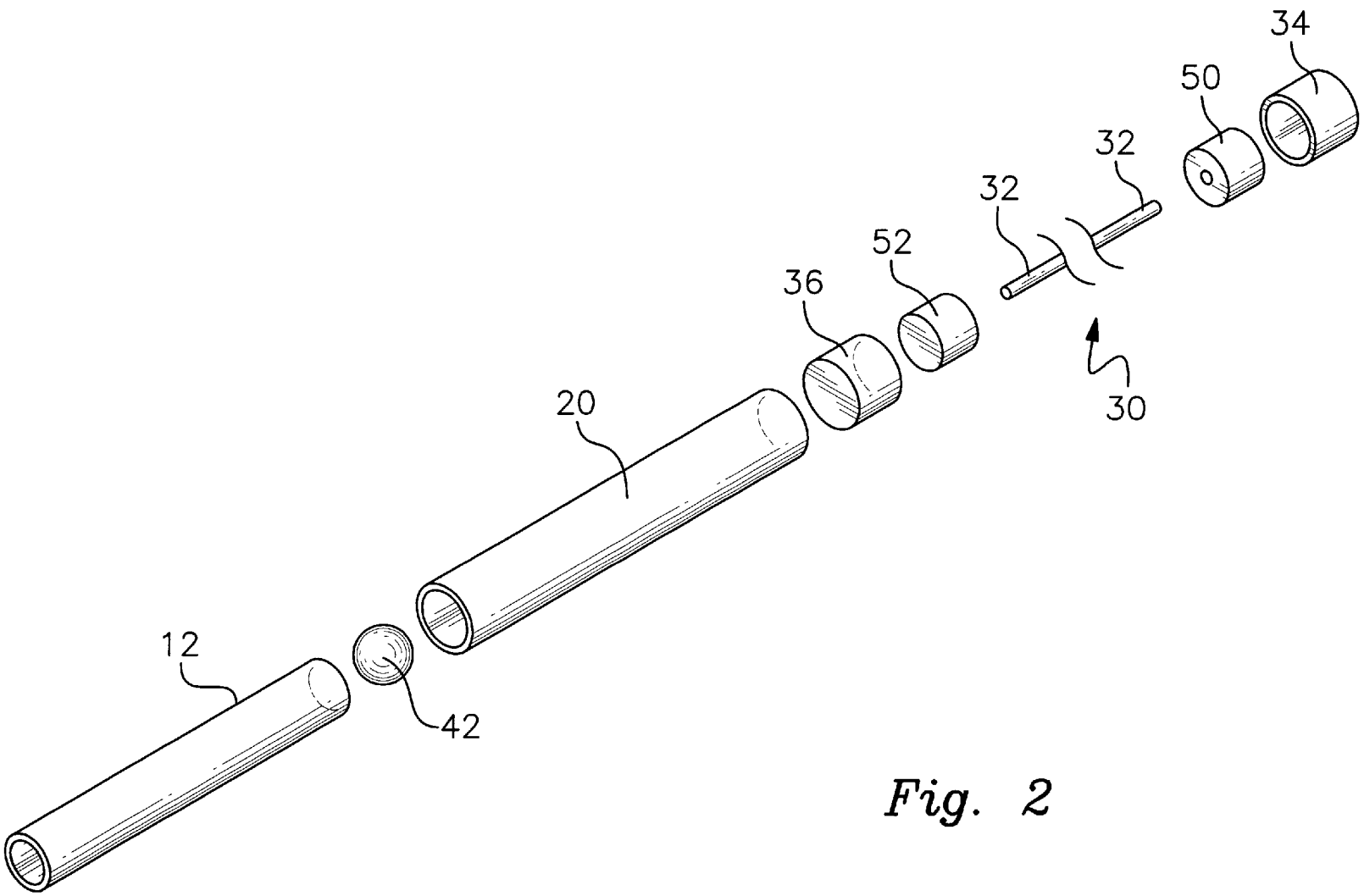
FIG. 2 is an exploded isometric view of the pivot mechanism for mounting an exterior decorative frame and an interior decorative component such that they are independently rotatable relative to one another and relative to the support member.
Figure 3:
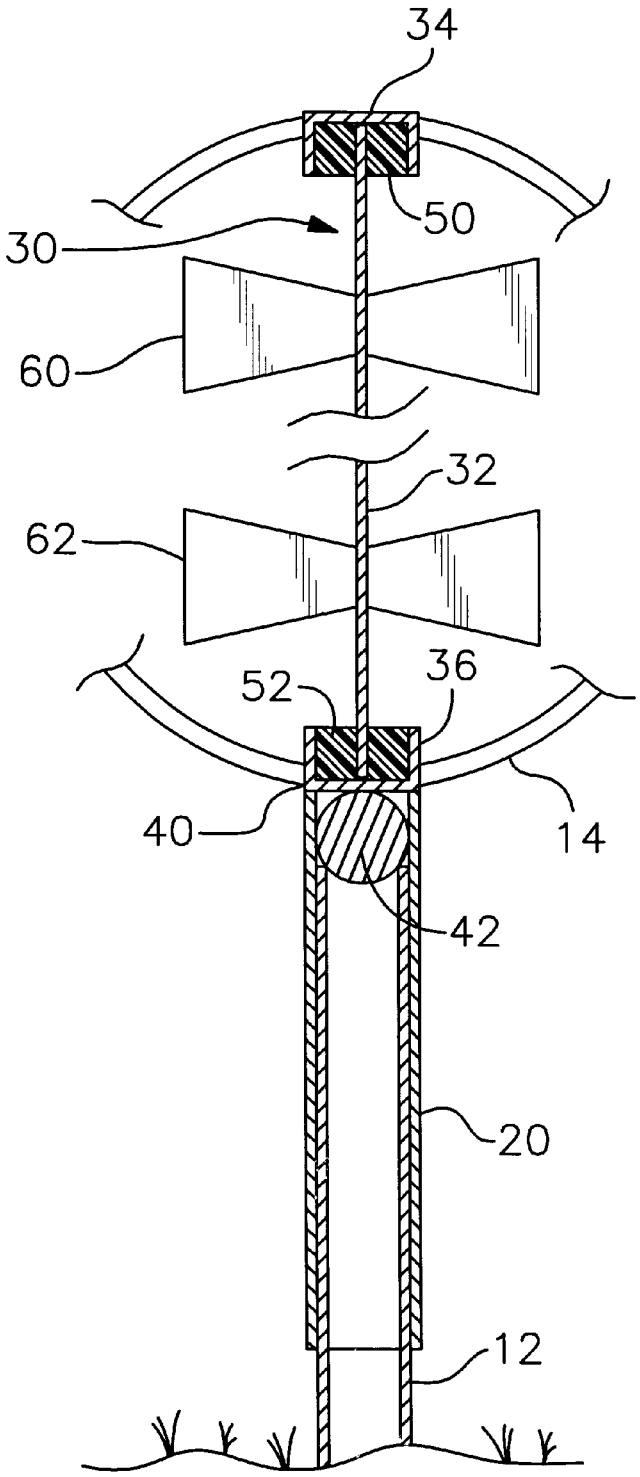
FIG. 3 is an elevational cross sectional view of the operative components of the sculpture.

The pivoting mechanisms of this invention are illustrated more clearly in FIGS. 2 and 3. As shown therein, support member 12 comprises an elongate tubular element that is received in close, yet rotatable tolerance within sleeve 20. Sleeve 20 again preferably comprises a piece of copper tubing (alternative materials may also be used). Lower bearing cup 36 is a generally cup shaped receptacle. Both bearing cups are preferably composed of copper or similarly durable metals or plastics. Bearing cup 36 has a diameter that is similar to that of sleeve 20. The lower bearing cup is engaged with and attached to the upper end of sleeve 20. Typically, cup 36 is welded or otherwise permanently fixed to the upper end of the sleeve. As a result, the bottom surface 40 of cup 36 forms a plug or closure at the upper end of sleeve 20. See FIG. 3. This forms a bearing surface for the rotatable interconnection between the support member and the frame. A first bearing 42, which comprises a ball bearing or similar component (such as a polished marble) is interengaged between the upper end of tubular support member 12 and closure 40. Bearing 42 has a diameter that is larger than the central opening of support member 12 but smaller than the interior diameter of sleeve 20. As a result, bearing 42 fits within sleeve 20 and seats in the upper end of tubular support member 12. The bearing engages the lower surface of closure 40. As a result, closure 40, bearing cup 36 and sleeve 20 (which are permanently interconnected) are able to spin or rotate relative to tubular support member 12. There is sufficient clearance between the interior surface of sleeve 20 and the exterior surface of support member 12 to allow the components to freely rotate. The ball bearing form of interengagement provides for relatively low friction rotation of the sleeve, and therefore the attached frame 14, about the support member.

Each,of the bearing cups or receptacles accommodates an annular plastic bearing portion. In particular, bearing cup 34 carries an upper bushing 50 and lower bearing cup 36 carries a lower bushing 52. The bushings may be fastened within the respective bearing cups (adhesively or otherwise) or may be loosely contained within the receptacles. A suitable plastic or other relatively friction-free material is preferred for the bushings. Each bushing has a central opening that receives a respective end of elongate spinner shaft 32. When the shaft is received by the respective bushings, it is permitted to rotate axially therein. As a result, the blades or other decorative components carried by shaft 32 are allowed to spin within the exterior frame. In FIG. 3, a pair of blades 60 and 62 are shown welded or otherwise attached to the spinner shaft. In certain versions, rotation may be further facilitated by employing a suitable grease or lubricant in one or more of the bearing cups.

The above-described construction allows the exterior frame and interior decorative components to rotate independently both relative to one another and relative to support member 12 about respective axes. The frame rotates about an axis defined by the cylindrical sleeve 20. The interior decorative component, e.g. blades 60 and 62, rotates about a second axis defined by shaft 32. Both the first and second axes are generally aligned with one another and aligned with the axis of support member 12. When wind strikes the decorative sculpture 10, the exterior frame is turned or spun and the interior decorative component is independently rotated. These components may rotate together or in opposing directions. In either case, an attractive aesthetic ornament is achieved. The pivoting interconnection described above permits the independent parts of the sculpture to rotate with very little friction. The sculpture is durable and exhibits a long operational life. Little, if any maintenance is required.

Figure 4:
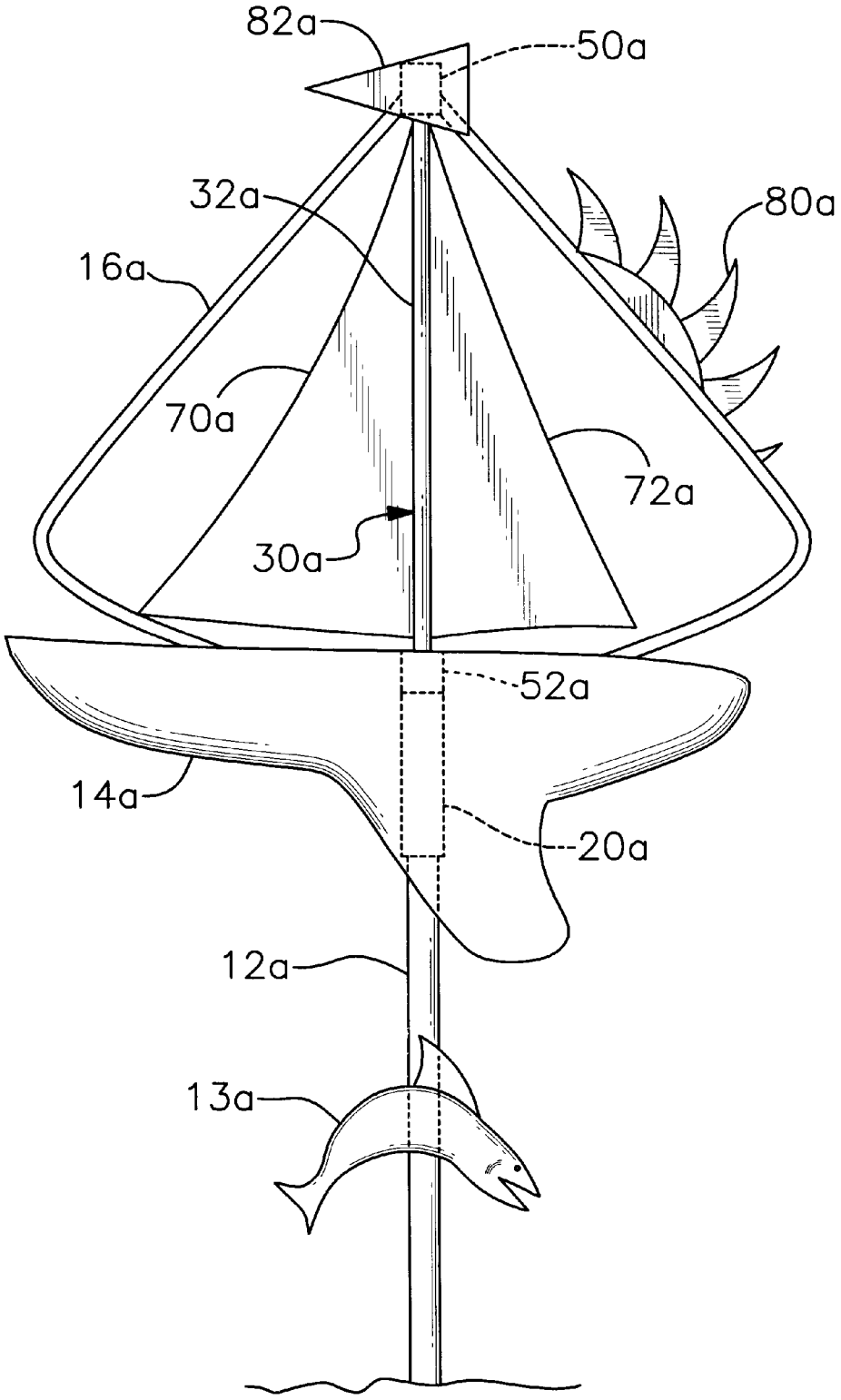
FIG. 4 is an elevational view of an alternative preferred design utilizing the structure of this invention.

An alternative sculptural design utilizing the construction of this invention is depicted in FIG. 4. Therein, a support member 12*a* carries a decorative exterior frame 14*a* in the form of a sailboat. Other decorative components, such as in this case a dolphin 13*a* may be mounted to the support member. Once again, a sleeve 20*a* is pivotably mounted to support member 12*a* in a manner previously described. A spindle assembly 30*a* is mounted above sleeve 20*a* and a pair of decorative components 70*a* and 72*a* comprising sails of the sailboat are welded or otherwise permanently secured to a shaft 32*a* of spinner assembly 30*a*. Shaft 32*a* is rotatably mounted in bearing cups 50*a* and 52*a* that are attached to the frame in a manner previously described. The details of construction in the earlier described version apply analogously to the embodiment of FIG. 4.

It should be noted in FIG. 4 that the frame includes a wire element 16*a* that generally traces the shape of the boat's sails. A sunburst 80*a* comprised of copper or similar material is welded, soldered or otherwise attached to wire 16*a*. The upper bearing cup 50A is secured to a pennant member 82*a*.

Once again, the second embodiment described herein provides the benefits of attractiveness, little or no maintenance and durability.

Still other modifications may be made within the scope of this invention. Various types of alternative bearings may be used for mounting the frame to the support member and the interior decorative member to the frame. In all cases, however, it is important that the interior decorative component and the exterior frame be pivotable independently of one another and that there axes of rotation be substantially aligned with one another and with the longitudinal axis of the support member.

Although the ball bearing is shown as seated in the tubular support member, in alternative versions, it may be received within its own bearing cup, pocket or other structure.

What is claimed is:

1. A decorative wind driven sculpture comprising:

an elongate support member including an elongate tube that is mounted to and extends upwardly from the ground, which support member has a longitudinal axis;

an exterior frame mounted proximate an upper end of said support member for rotating about a vertical pivot axis that is aligned with and comprises an extension of said longitudinal axis of said support member;

an interior decorative component mounted within said frame on a vertical shaft that is rotatable within and independently of said frame about said vertical pivot axis;

a generally cylindrical sleeve attached to said frame, said sleeve being axially aligned and rotatably interengaged with said tube, said sleeve receiving said support member; and bearing means for rotatably interengaging said sleeve and said support member;

whereby said exterior frame and said interior decorative component are rotated independently about said vertical pivot axis by movement of wind across said sculpture.

2. The device of claim 1 in which said bearing means include a closure carried by said sleeve proximate an upper end thereof and a first bearing that interengages the upper end of the aid support member and said closure.

3. The device of claim 2 in which said first bearing includes a ball bearing element.

4. The device of claim 2 further including a spinner assembly mounted to said sleeve, said spinner assembly including a second bearing connected to said closure, a third bearing mounted to said frame, and said shaft, which shaft is rotatably interconnected between said second and third bearings and carries said interior decorative component, which interior decorative component rotates with said shaft about said vertical pivot axis, which is defined by a longitudinal axis of said shaft.

5. The device of claim 4 in which said second bearing is mounted in a lower bearing receptacle, which lower bearing receptacle includes said closure, and said third bearing is mounted in an upper bearing receptacle, which upper bearing receptacle is secured to said frame.

6. The device of claim 5 in which said second and third bearings comprise annular bushings.

* * * * *